US005846050A

United States Patent [19]

Schilling

[11] Patent Number: 5,846,050

[45] Date of Patent: Dec. 8, 1998

[54] VANE SECTOR SPRING

[75] Inventor: Jan C. Schilling, Middletown, Ohio

[73] Assignee: General Electric Company, Cincinnati, Ohio

[21] Appl. No.: 891,913

[22] Filed: Jul. 14, 1997

[51] Int. Cl.[6] ..... F01D 9/04

[52] U.S. Cl. ..... 415/135; 415/209.2; 415/209.3; 415/190

[58] Field of Search ..... 415/209.2, 209.3, 415/209.4, 189, 190, 135, 139, 119; 416/190

[56] References Cited

U.S. PATENT DOCUMENTS

| | | | |
|---|---|---|---|
| 2,991,045 | 7/1961 | Tassoni . | |
| 3,938,906 | 2/1976 | Michel et al. | 415/139 |
| 3,947,145 | 3/1976 | Michel et al. | 415/217 |
| 4,897,021 | 1/1990 | Chaplin et al. | 415/173.7 |
| 5,141,395 | 8/1992 | Carroll et al. | 415/209.2 |
| 5,176,496 | 1/1993 | Correia et al. | 415/209.2 |
| 5,318,402 | 6/1994 | Bailey et al. | 415/139 |
| 5,333,995 | 8/1994 | Jacobs et al. | 415/209.2 |

FOREIGN PATENT DOCUMENTS

| | | | |
|---|---|---|---|
| 629283 | 10/1961 | Canada . | |
| 0017534 | 10/1980 | European Pat. Off. . | |
| 2647-630 | 5/1977 | Germany | 415/134 |

*Primary Examiner*—Edward K. Look
*Assistant Examiner*—Richard Woo
*Attorney, Agent, or Firm*—Andrew C. Hess; David L. Narciso

[57] ABSTRACT

A seating spring is provided for a compressor stator having a radially outer casing with a circumferential casing slot for mounting a plurality of circumferentially adjoining vane sectors at outer bands thereof. The seating spring includes a reaction tab configured to abut the casing at one side of the casing slot. A resilient spring arm is fixedly joined to the reaction tab and is configured to abut a respective one of the outer bands to in-turn bias the one outer band against the casing at an opposite side of the casing slot.

12 Claims, 3 Drawing Sheets

VANE SECTOR SPRING

BACKGROUND OF THE INVENTION

The present invention relates generally to gas turbine engines, and, more specifically, to compressor stators therein.

A gas turbine engine includes a compressor typically including a plurality of axial stages which compress airflow in turn. A typical axial compressor includes a split outer casing having two 180° segments which are suitably bolted together at an axial splitline. The casing includes rows of axially spaced apart casing slots which extend circumferentially therearound for mounting respective rows of vane segments or sectors.

A typical vane segment includes radially outer and inner bands between which are attached a plurality of circumferentially spaced apart stator vanes. The outer band includes a pair of axially spaced apart forward and aft rails, which are typically L-shaped with corresponding forward and aft hooks. The casing includes complementary forward and aft grooves which extend circumferentially within each of the casing slots for receiving the corresponding rails in a tongue-and-groove mounting arrangement.

During assembly, the individual vane sectors are circumferentially inserted into respective ones of the casing halves by engaging the forward and aft hooks with the corresponding forward and aft grooves. Each vane sector is slid circumferentially in turn into the casing slot until all of the vane sectors in each casing half are assembled. The two casing halves are then assembled together so that the vane sectors in each casing slot define a respective annular row of adjoining sectors for each compression stage.

A conventional compressor rotor having corresponding rows of compressor blades is suitably disposed within the compressor stator. And, conventional sealing shrouds or segments are suitably attached to the radially inner bands of the vane sectors to cooperate with labyrinth teeth extending from the compressor rotor for effecting interstage seals.

In this configuration, the individual vane sectors are mounted to the outer casing solely by their outer bands, with the vanes and inner bands being suspended therefrom. The tongue-and-groove mounting arrangement therefore requires suitable clearance for not only allowing assembly of the vane sectors, but for also allowing differential thermal expansion and contraction between the components during operation of the compressor.

Typical manufacturing tolerances and stack-up thereof create clearances or gaps between the outer bands and the casing. During operation, air is compressed in each of the compressor stages and effects tangential and axially forward resultant aerodynamic loads acting on the vane sectors. The axial load urges the vane sectors forwardly and is reacted by axial engagement between the forward rail and the forward side of the casing slot, while increasing the axial gap between the aft side of the casing slot and the outer band. The tangential load is reacted by a typical anti-rotation key disposed in the casing slot at the casing splitline.

Since the compressor rotor excites vibratory response of the vane sectors during operation, and the vane sectors experience differential thermal expansion and contraction relative to the casing, the interfacing components thereof are subject to vibratory and thermal movement which may cause frictional wear. In order to reduce such frictional wear, conventional wear coatings or wear shims are provided. However, the coatings and shims are also subject to typical manufacturing tolerances and stack-up clearances, and do not abate the underlying frictional wear mechanism.

Accordingly, it is desired to provide an improved compressor stator having reduced axial free play between the vane sectors and the stator casing while allowing differential thermal expansion and contraction during operation.

SUMMARY OF THE INVENTION

A seating spring is provided for a compressor stator having a radially outer casing with a circumferential casing slot for mounting a plurality of circumferentially adjoining vane sectors at outer bands thereof. The seating spring includes a reaction tab configured to abut the casing at one side of the casing slot. A resilient spring arm is fixedly joined to the reaction tab and is configured to abut a respective one of the outer bands to in-turn bias the one outer band against the casing at an opposite side of the casing slot.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
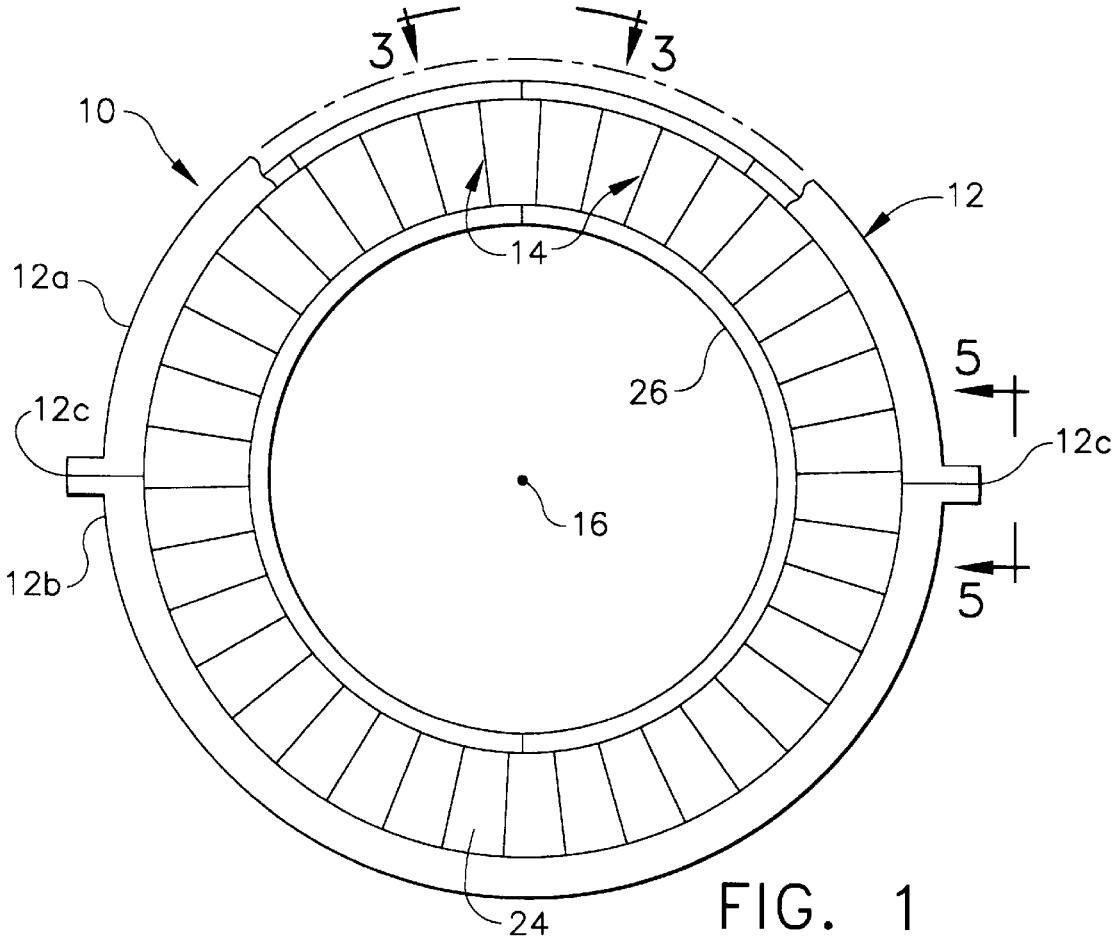
FIG. 1 is an elevational view through a portion of a gas turbine engine compressor stator having a plurality of circumferentially adjoining vane sectors mounted therein in accordance with an exemplary embodiment of the present invention.

Illustrated in FIG. 1 is an exemplary compressor stator 10 for an axial flow compressor in a gas turbine engine (not shown). The stator 10 includes an annular outer casing 12 conventionally formed in two 180° halves 12*a,b* which are conventionally fixedly joined together along a pair of axial splitlines 12*c*. A plurality of circumferentially adjoining vane sectors 14 are mounted to the casing 12 in accordance with the present invention to form a single row disposed coaxially about an axial or longitudinal centerline axis 16 of the stator.

Figure 2:
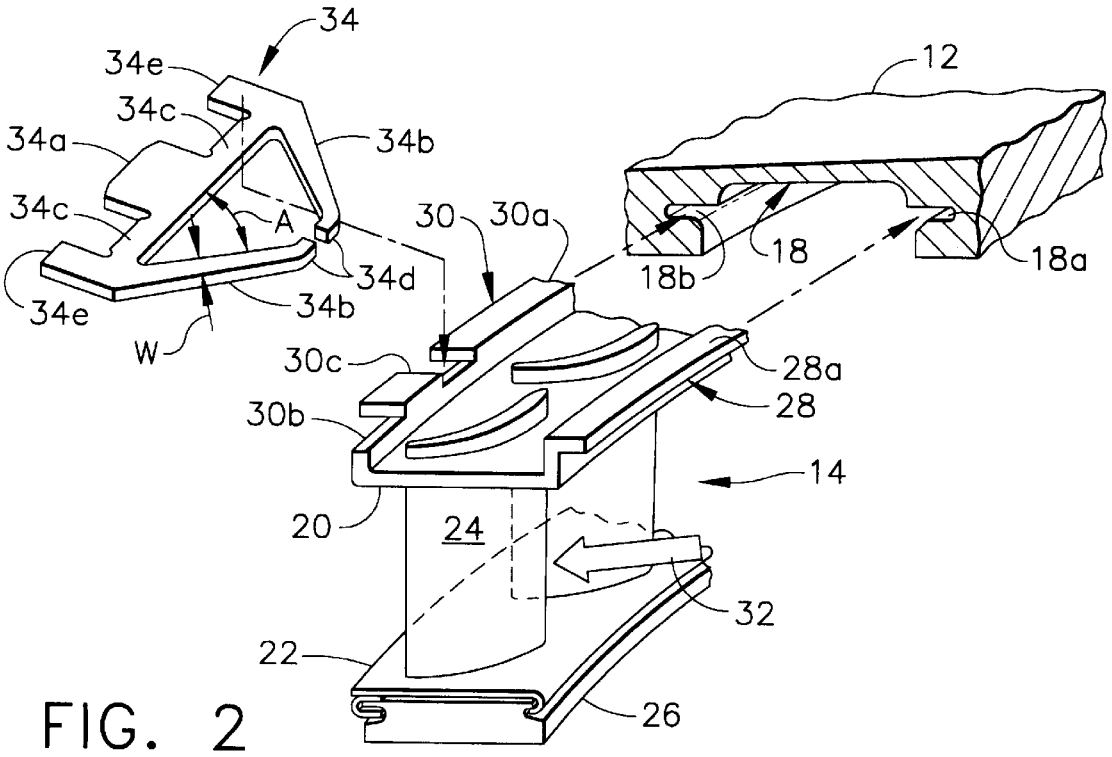
FIG. 2 is an exploded view of a portion of the compressor stator illustrated in FIG. 1 showing assembly of an individual vane sector into an outer casing with a seating spring for biasing the vane sector in an axially forward direction.

As shown in more particularity in FIG. 2, the casing 12 includes a circumferential casing slot 18 configured for removably mounting the vane sectors 14 in a tongue-and-groove manner for allowing ready assembly and disassembly thereof. Each vane sector 14 includes an arcuate radially outer band 20, and an arcuate radially inner band 22 spaced therefrom and between which are fixedly mounted a plurality of circumferentially spaced apart stator vanes 24. The vanes 24 may be joined to the outer and inner bands in any conventional fashion and typically include five or more vanes per sector, for example. The inner bands 22 may have any conventional form for suitably mounting conventional sealing shrouds or segments 26 which cooperate with conventional labyrinth teeth of a cooperating compressor rotor (not shown).

In the preferred embodiment illustrated in FIG. 2, each of the outer bands 20 includes forward and aft outer rails 28, 30 which extend circumferentially therealong. The rails 28, 30 are generally L-shaped in section, with the forward rail 28 having an axially extending forward hook 28*a,* and the aft rail 30 having an axially extending aft hook 30*a*.

Correspondingly, the casing 18 includes an axially extending forward groove 18*a* which also extends circumferentially along the casing slot 18 to define a respective forward casing hook. The casing 18 also includes an axially extending aft groove 18*b* which also extends circumferentially along the casing slot 18 to define a corresponding aft casing hook.

The forward rail hook 28*a* extends forwardly from the outer band 20 and is configured to slidingly engage the casing forward groove 18*a* in a conventional tongue-and-groove arrangement. Similarly, the aft rail hook 30*a* extends in an aft direction and is configured to slidingly engage the casing aft groove 18*b* in a conventional tongue-and-groove arrangement. The terms forward and aft as used herein are relative to the primary direction of airflow 32 traveling downstream between the vanes 24 of each of the compressor stages. As the airflow 32 travels downstream, it is compressed in turn by each succeeding stage of the compressor for elevating its pressure.

The compressor stator 10 as so described is conventional in configuration, but is modified in accordance with the present invention for reducing or eliminating axial free-play clearance between the outer bands 20 and the casing 12 in which they are mounted. The tongue-and-groove mounting arrangement of the vane sectors in the casing 12 necessarily includes manufacturing tolerances on the individual components thereof which result in stack-up clearances when assembled.

In order to reduce or eliminate the axial component of such stack-up clearances, the present invention includes a removable seating spring 34 specifically configured to cooperate with the casing 12 and outer bands 20 to preferentially bias the vane sectors in their mounting slots 18. In the exemplary embodiment illustrated in FIG. 2, and in more particularity in FIGS. 3 and 4, minor modifications to the outer band 30 may be made for allowing retrofit of the seating spring 34 in an otherwise conventional mounting arrangement for taking up axial free play.

Figure 3:
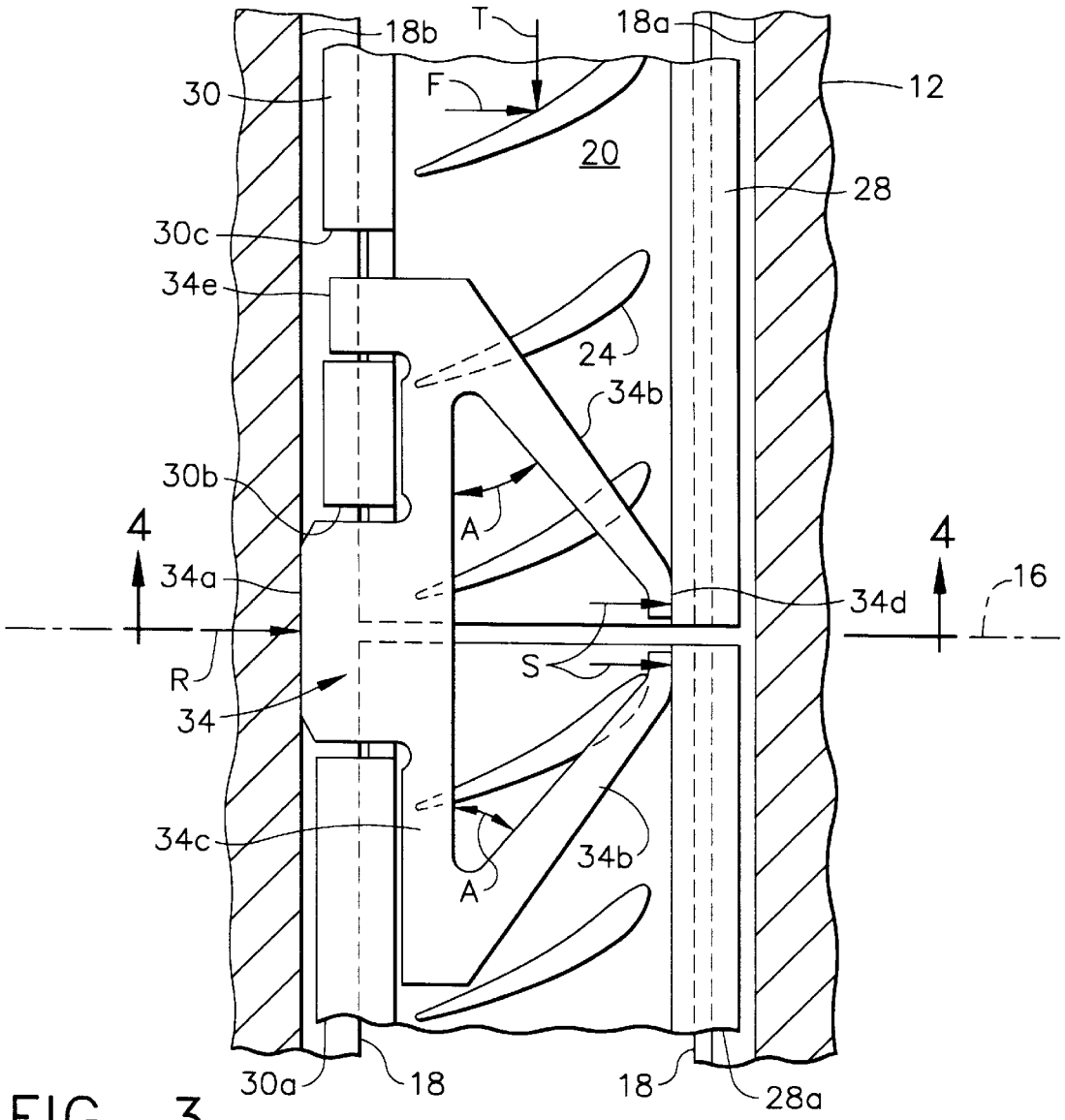
FIG. 3 is a top view of a portion of the compressor stator illustrated in FIG. 1 and taken generally along line 3—3 for showing assembly of the seating spring and vane sector of FIG. 2 in a corresponding slot in the outer casing.
Figure 4:
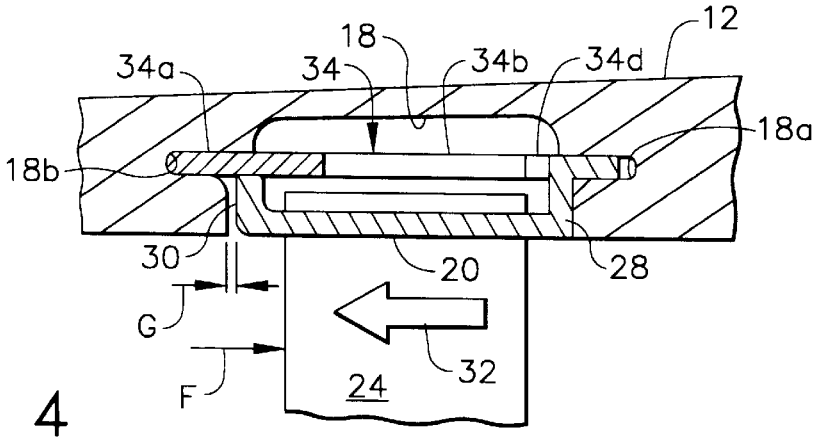
FIG. 4 is an elevational, partly sectional view through the stator portion illustrated in FIG. 3 and taken along line 4—4.

More specifically, and referring to FIGS. 3 and 4, the seating spring 34 preferably includes a reaction tab 34*a* configured to abut or engage the casing 12 at the aft side of the casing slot 18, and a resilient or flexible spring arm 34*b* fixedly joined to the reaction tab 34*a* and configured to engage or abut a respective one of the outer bands 20 to in-turn axially bias or preload the outer band 20 against the casing 12 at the opposite forward side of the casing slot 18. In the exemplary embodiment illustrated in FIG. 3, the spring arm 34*b* is inclined at an acute angle A from the reaction tab 34*a,* or from the circumferential direction, to effect cantilever spring flexibility relative thereto to bias the outer band 20 axially against the casing 12 at the forward groove 18*a*.

The seating spring 34 may be formed of a suitable metal and configured and sized to effect a suitable spring force S against the forward rail 28, for example, of the outer band 20.

As shown in FIG. 2, the individual springs 34 may be simply mounted atop the respective outer bands 20 during assembly into the casing slot 18, with initial compression of the spring arm 34*b* effecting the spring force S which will bias the outer band 20 at the forward rail 28 in axial engagement against the casing 12 at the forward groove 18*a* as illustrated in more particularity in FIG. 4. Accordingly, a single axial gap G remains between the aft rail 30 and the casing 12 at the aft groove 18*b*.

As shown in FIG. 4, the airflow 32 travels forward-to-aft and effects a resultant axial force F which acts on the vanes 24 in the aft-to-forward direction. As the compressor is operated at higher speed with a corresponding increase in the resultant axial force F, that axial force F alone will be effective to maintain seating of the outer band 20 against the forward side of the casing slot 18 with minimal vibratory movement therebetween. However, at relatively low aerodynamic loading of the vanes 24 the resultant axial force F may not be adequate to restrain axial vibratory motion of the outer band 20, and therefore the seating spring 34 provides a suitable additional axial force S to maintain the axially aft seating of the outer band 20 in the slot 18.

Accordingly, the seating spring 34 need only be sized for providing a relatively small seating force S during light aerodynamic loading of the vanes 24. The spring 34 may then prevent undesirable moving of the outer band 20 during operation which would otherwise promote frictional wear. Conventional wear coatings or shims may therefore be eliminated if desired.

Transient operation of the compressor results in differential temperatures across the components thereof which causes differential thermal expansion and contraction. At steady state operation with the components being stabilized at a uniform temperature, differential movements are eliminated. Accordingly, the spring arm 34*b* may be a different material than the remainder of the seating spring 34 having different coefficients of thermal expansion so that the axial force S exerted on the sector during transient operation may be optimized, and is different than the axial force exerted once the compressor is stabilized at steady state.

As shown in FIG. 3, the seating spring 34 preferably also includes a reaction arm 34*c* fixedly joining the spring arm 34*b* to the reaction tab 34*a* in an integral one-piece plate form. The acute inclination angle A of the spring arm 34*b* may then be measured relative to the reaction arm 34*c* which extends in the circumferential direction. For example, the inclination angle A may be about 45°.

The spring arm 34*b,* as illustrated for example in FIG. 2, is preferably integrally joined at a proximal or base end to the reaction arm 34*c,* and includes a tip 34*d* at an opposite distal end for engaging the outer band 20 preferably on the backside of the forward rail 28. The spring arm 34*b* preferably tapers or converges in size or width W from the reaction arm 34*c* to the tip 34*d* to provide a variable spring rate increasing in magnitude as the tip 34*d* is compressed toward the reaction tab 34*a*.

As shown in FIGS. 3 and 4, the aft rail 30 preferably includes a first cutout or notch 30*b* preferably extending axially through the aft hook 30*a* for allowing the reaction tab 34 to directly abut the casing 12 at the aft side of the casing slot 18 in the aft groove 18*b*. The spring arm 34*b* correspondingly extends axially between the aft and forward rails

30, 28 to abut the backside of the forward rail 28 along the forward rail hook 28*a*. As shown in FIG. 4, this allows a compact assembly of the seating spring 34 within the available space in the casing slot 18, with the simple modification of the aft rail 30 to include the first notch 30*b*.

The reaction tab 34*a* as shown in FIG. 3 therefore slidably extends through the first notch 30*b* to engage the aft groove 18*b*, with the spring arm 34*b* extending axially between the aft and forward hooks 30*a*, 28*a* to engage the backside of the forward hook 28*a* to bias the outer band 20 toward the casing forward groove 18*a*. Since the reaction tab 34*a* fictionally engages the aft groove 18*b*, and the spring arm tip 34*d* frictionally engages the forward rail 28, the outer bands 20 remain free to expand and contract circumferentially relative to the casing 12 in the slot 18 without undesirable restraint.

As shown in FIG. 3, the reaction arm 34*c* extends parallel to the backside of the aft rail 30 with a suitably small axial gap therebetween. Tangential movement of the outer band 20 will develop a moment or couple around the seating spring 34 which may be reacted by contact of the reaction arm 34*c* against the backside of the aft rail 30 which stabilizes the seating spring 34 during operation.

In the preferred embodiment illustrated in FIG. 3, a pair of spring arms 34*b* are symmetrically mounted at opposite circumferential ends of each of the vane sectors at their outer bands 20, with each of the spring arms 34*b* extending circumferentially outwardly in each of the outer bands 20 to position the tips 34*d* at the opposite circumferential ends, or sector splitlines. In this way, the spring arms 34*b* spread apart outwardly to their respective tips 34*d* to locate the seating force S at the very ends of each outer band 20 to provide uniform circumferential seating thereof and stability. Alternatively, the spring arms 34*b* could be inclined oppositely to the direction illustrated in FIG. 3 and spread circumferentially together toward each other for positioning the tips 34*d* inwardly of the circumferential ends of the outer bands (not shown).

Also in the preferred embodiment illustrated in FIG. 3, a plurality of the seating springs 34 are provided for the several vane sectors 14, with suitable ones of the seating springs 34 each including a common reaction tab 34*a*, with a pair of the reaction arms 34*c* extending circumferentially outwardly therefrom. And, a respective pair of the spring arms 34*b* extend circumferentially inwardly from the respective reaction arm 34*c* in axial symmetry and in a one-piece construction which bridges an adjacent pair of vane sectors 14 at the common splitline between the outer bands 20 thereof.

Figure 5:
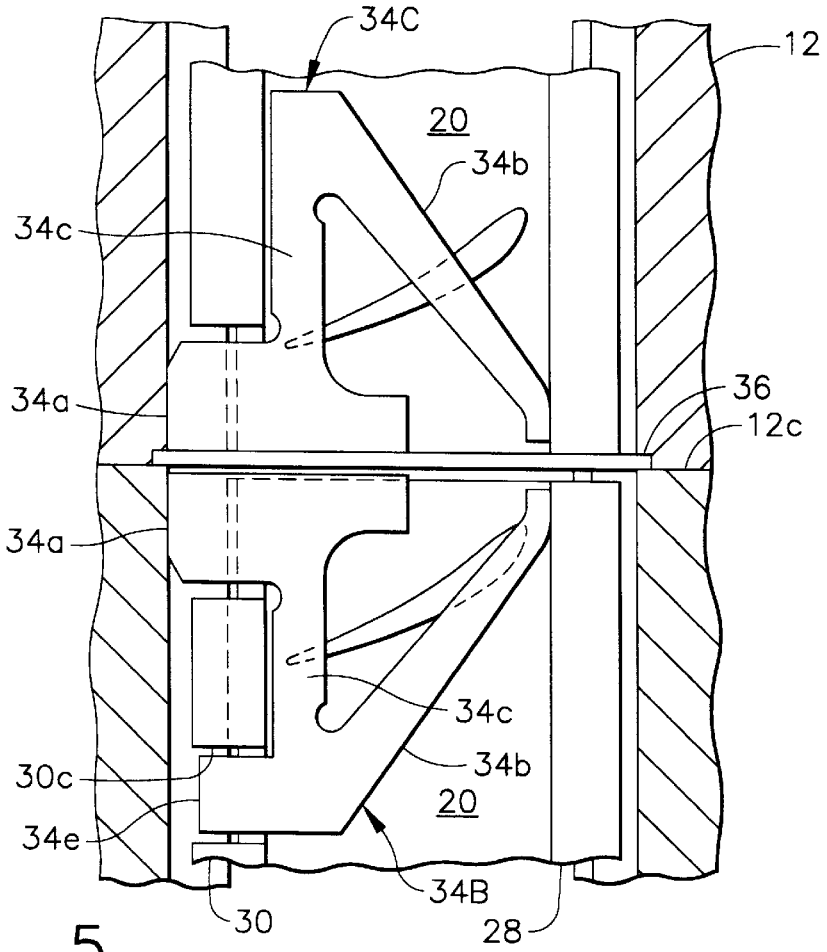
FIG. 5 is a top view of different forms of the seating spring for mounting the vane sectors at the casing splitline in FIG. 1 and taken generally along line 5—5.

FIG. 5 illustrates two additional embodiments of the seating springs designated 34B and 34C which are configured basically as half-springs of the embodiment illustrated in FIG. 3 with a single spring arm 34*b* connected to a corresponding reaction arm 34*c*, which in turn is connected to the reaction tab 34*a*. These half-springs 34B and 34C may be used where the outer bands 20 join the casing splitline 12*c*.

The circumferential or tangential component of the resultant aerodynamic load acting on the vanes 24 is designated T and is illustrated in FIG. 3. In order to prevent rotation of the vane sectors 14 circumferentially within the casing slot 18 against this tangential force T, the stator includes a conventional anti-rotation key 36 illustrated in FIG. 5 at the splitline 12*c*. The tangential forces acting on the individual vanes 24 are carried circumferentially between the outer band 20 and are collectively reacted through the key 36 which carries this load into the casing 12. If desired, the key 36 may be integrally formed with the half-spring 34C illustrated in FIG. 5.

As shown in FIG. 3, each of the seating springs 34 may further include an additional, mounting tab 34*e* extending axially from the juncture of the spring arm 34*b* and the reaction arm 34*c* in the same axial direction as the reaction tab 34*a* and spaced circumferentially therefrom. Correspondingly, the aft rail 30 includes a complementary second cutout or notch 30*c* through the aft rail hook 30*a* for circumferentially engaging the respective mounting tab 34*e*. The mounting tab 34*e* is preferably axially shorter than the reaction tab 34*a* so that it does not axially abut the casing aft groove 18*b*.

The mounting tab 34*e* provides a convenient element for removing the vane segments 14 from the casing slot 18 during disassembly thereof by simply pulling one end of the seating spring 34 itself. It also assists in assembly in the opposite manner. If desired, each of the reaction tabs 34*a* may have suitable lead-ins or chamfers at the circumferentially opposite corners thereof as illustrated in FIG. 3 to improve assembly of the individual seating springs 34 as they are compressed into position.

Figure 6:
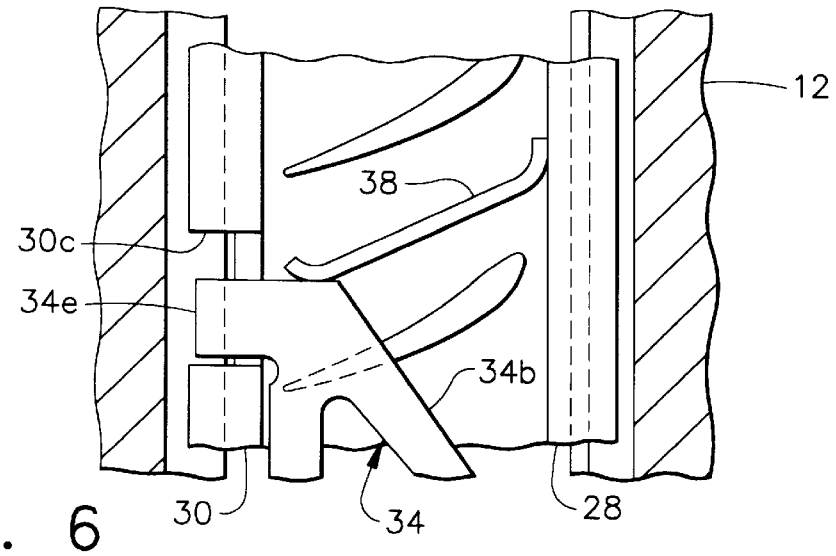
FIG. 6 is a top view of a portion of the seating spring and vane sector illustrated in FIG. 3 in accordance with another embodiment of the present invention.

As shown in FIG. 6, an additional spring damper 38 may be suitably fixedly joined at one end to the backside of the forward rail 28, by brazing or welding for example, and extends axially aft in a cantilever fashion, with a distal end frictionally engaging the side of the seating spring 34 at the base of the spring arm 34*b*. In this way, axial friction damping may be provided between the damper 38 and the seating spring 34 for damping rigid body motion of the seating spring 34 if desired. This also effectively dampens the entire vane sector 14 to the casing 12.

The various embodiments of the seating springs 34 disclosed above provide various advantages in a relatively simple assembly which may be readily retrofitted to conventional designs if desired. The springs 34 provide positive axial seating loads on the individual sectors 14, while allowing the sectors to move axially and circumferentially for thermal excursions. Conventional wear coating or wear shims may be eliminated in view of the reduced vibratory motion of the vane sectors effected by the seating springs 34. The springs may be configured for bridging adjacent vane sectors, or providing seating force confined to individual sectors in the half-spring configuration disclosed. The seating spring itself, since it fictionally engages the casing and the outer band, inherently provides damping for the individual vane sectors which is not otherwise provided.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

I claim:

1. For a gas turbine engine compressor stator including a radially outer casing with a circumferential casing slot for mounting a plurality of circumferentially adjoining vane sectors at outer bands thereof, a seating spring comprising:

a reaction tab configured to abut said casing at one side of said casing slot; and a resilient spring arm fixedly joined to said reaction tab and configured to abut a respective one of said outer bands to in-turn bias said one outer band against said casing at an opposite side of said casing slot.

2. A seating spring according to claim 1 in combination with said compressor stator and mounted in said casing slot to bias said one outer band against said casing at said opposite side of said casing slot.

3. A seating spring according to claim 1 wherein said spring arm is inclined at an acute angle to said reaction tab to effect cantilever spring flexibility relative thereto to bias said one outer band axially against said casing.

4. A seating spring according to claim 3 in combination with said compressor stator, and mounted in said casing slot to axially bias said one outer band against said casing at said opposite side of said casing slot.

5. A seating spring according to claim 3 further comprising a reaction arm fixedly joining said spring arm to said reaction tab in a one-piece plate.

6. A seating spring according to claim 5 wherein said spring arm is integrally joined at a proximal end to said reaction arm, and includes a tip at an opposite distal end for engaging said one outer band, and tapers in size from said reaction arm to said tip.

7. A seating spring according to claim 6 in combination with said compressor stator, and mounted in said casing slot to axially bias said one outer band against said casing at said opposite side of said casing slot; and wherein:

said one outer band includes forward and aft rails extending circumferentially in said casing slot to mount said vane sector to said casing; and said aft rail includes a notch for allowing said reaction tab to abut said casing at an aft side of said casing slot, with said spring arm extending between said aft and forward rails to abut said forward rail.

8. An apparatus according to claim 7 wherein:

said casing further includes forward and aft grooves extending circumferentially along said casing slot on opposite sides thereof;

said forward rail includes a forward hook disposed in said forward groove;

said aft rail includes an aft hook disposed in said aft groove, with said notch being disposed in said aft hook; and said reaction tab slidably extends through said notch to engage said aft groove, and said spring arm extends between said aft and forward hooks to engage said forward hook to bias said outer band toward said forward groove.

9. An apparatus according to claim 8 further comprising a pair of said spring arms mounted at opposite circumferential ends of each of said vane sectors, with each of said spring arms extending circumferentially outwardly in each of said outer bands to position said tips at said opposite circumferential ends.

10. An apparatus according to claim 9 wherein said seating spring includes a common reaction tab, with a pair of said reaction arms extending circumferentially outwardly therefrom, and a respective pair of said spring arms extending circumferentially inwardly from said reaction arms.

11. An apparatus according to claim 7 further comprising a spring damper fixedly joined at one end to said forward rail, and having an opposite end disposed in frictional engagement with said seating spring to dampen vibration thereof.

12. A seating spring according to claim 3 configured as a half-spring including a single spring arm joined to a single reaction tab.

* * * * *